United States Patent [19]

Tachino et al.

[11] Patent Number: 4,485,895

[45] Date of Patent: Dec. 4, 1984

[54] ELEVATOR SYSTEM

[75] Inventors: Kanzo Tachino; Ryuichi Kajiyama, both of Aichi, Japan

[73] Assignee: Mitsubishi Denki Kabushiki Kaisha, Tokyo, Japan

[21] Appl. No.: 509,117

[22] Filed: Jun. 29, 1983

[30] Foreign Application Priority Data

Jul. 21, 1982 [JP] Japan ..... 57-127047

[51] Int. Cl.[3] ..... B66B 1/30

[52] U.S. Cl. ..... 187/29 R

[58] Field of Search ..... 187/29; 318/162, 567, 318/580

[56] References Cited

U.S. PATENT DOCUMENTS

| | | | |
|---|---|---|---|
| 4,034,856 | 7/1977 | Wehrli et al. | 187/29 |
| 4,337,847 | 7/1982 | Schröder et al. | 187/29 |
| 4,373,612 | 2/1983 | Caputo et al. | 187/29 |
| 4,446,946 | 5/1984 | Kajiyama et al. | 187/29 |

FOREIGN PATENT DOCUMENTS

| | | | |
|---|---|---|---|
| 54-153459 | 12/1979 | Japan | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system having an elevator car, a running speed pattern generator, and a landing speed pattern generator. The landing speed pattern generator includes a plurality of different landing patterns stored in memory. When the elevator car enters the landing zone of the target floor, the magnitude of the running speed pattern is detected and a landing speed pattern is selected in response to this magnitude. The selected landing speed pattern is substituted for the running speed pattern, to enable the elevator car to land smoothly and accurately at floor level, notwithstanding errors in the running speed pattern.

5 Claims, 6 Drawing Figures

ELEVATOR SYSTEM

BACKGROUND OF THE INVENTION

1. Field of the Invention

The invention relates in general to elevator systems, and more specifically to speed pattern generators for elevator systems.

2. Description of the Prior Art

The position of an elevator car may be determined by generating a distance pulse for each standard increment of car travel, such as a pulse for each 0.25 inch of travel, and by counting the pulses generated. The counter is set to a predetermined count at the lowest floor, and the count is incremented during up travel and decremented during down travel. The location of each floor of the associated building is stored in a suitable memory, in terms of a count value, using the standard increment. The position of the car may be compared with the location of a target floor, and when the count difference equals the desired slowdown distance, the slowdown phase of the run is initiated. The slowdown distance may be continuously maintained and decremented by the distance pulses, with the distance-to-go count being used to generate the slowdown speed pattern.

Theoretically, the slowdown speed pattern should be able to bring the car accurately to floor level. However, the distance pulses are usually detected by a pulse wheel driven by the traction sheave, or from the governor sheave. Slippage between the ropes and sheave grooves creates a mismatch between the actual car position and the position count, as does wear of the ropes and grooves. Thus, it is conventional to detect the actual presence of the elevator car when it reaches a predetermined landing distance from the target floor, and to switch from the normal speed pattern generator to an auxiliary speed pattern generator. This auxiliary or landing speed pattern generator is responsive to the absolute position of the elevator car relative to the target floor. Such an auxiliary speed pattern generator may develop a pattern from metallic plates disposed adjacent to each floor, which cooperate with electromagnetic windings carried by the elevator car. The metallic plates are shaped such that the pattern output voltage is reduced according to the actual position of the car relative to the target floor.

While the speed pattern transfer arrangement referred to above will stop the car accurately at floor level, it can produce a "bump" of sufficient magnitude that it is felt by passengers in the elevator car, if the mismatch between the normal slowdown speed pattern and the auxiliary or landing speed pattern exceeds a predetermined magnitude. The "bump" occurs as the speed error abruptly changes and the feedback control attempts to cause the car speed to change abruptly.

SUMMARY OF THE INVENTION

Briefly, the present invention is a new and improved elevator system in which the landing speed pattern generator includes a plurality of different landing speed patterns stored in a memory. The elevator car follows the slowdown phase of a conventional speed pattern generator, which may be responsive to the distance pulses from a pulse wheel arrangement, until a car position detector detects that the elevator car has reached a predetermined position from the target floor. The value of the running speed pattern at this point is used to select a landing speed pattern whose initial value closely matches the value of the running speed pattern. Thus, pattern mismatch may be minimized to the point where it does not create a noticeable "bump" in the elevator car.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
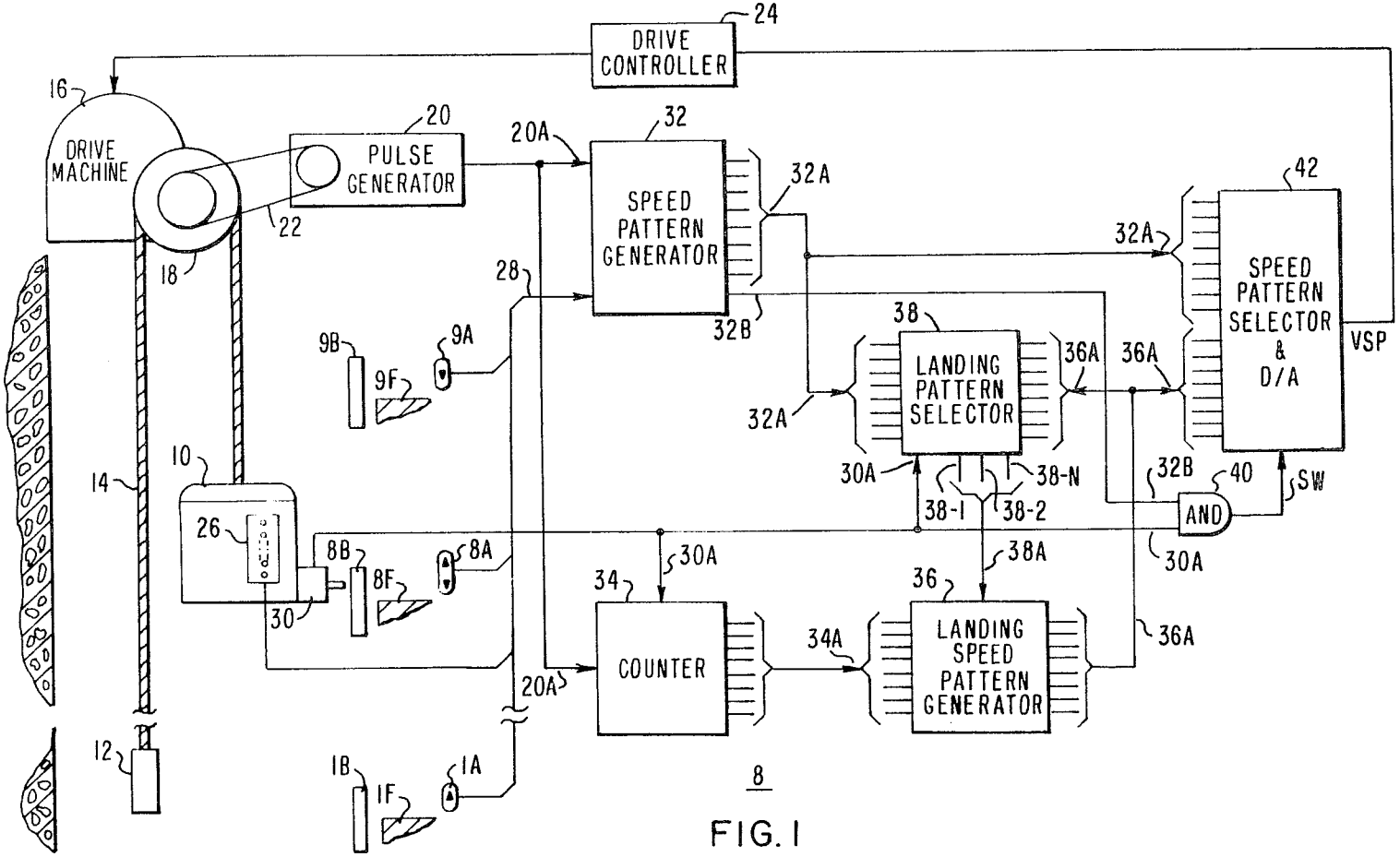
FIG. 1 is a block diagram of an elevator system constructed according to the teachings of the invention.

Referring now to the drawings, and to FIG. 1 in particular, there is shown an elevator system 8 constructed according to the teachings of the invention. Elevator system 8 includes an elevator car 10 mounted for vertical, guided movement in the hoistway of the building having a plurality of floors, such as the floors indicated generally at 1F, 8F and 9F. Elevator system 8 may be of the traction type illustrated, in which the elevator car 10 is connected to a counterweight 12 via a plurality of ropes 14 which are reeved over a traction sheave 18. Traction sheave 18 is driven by an elevator drive machine 16, which may include an AC or a DC motor.

Calls for elevator service are placed in the hallways of the various floors from hall call pushbuttons, such as the UP direction pushbutton 1A at floor 1F, the down direction pushbutton 9A at floor 9F, and the up and down pushbuttons 8A at floor 8F. Car calls are placed in the elevator car 10, such as via a plurality of car call pushbuttons 26. The car calls and hall calls, shown collectively as signal 28, are directed to a conventional floor selector and speed pattern generator, shown generally at 32.

The position of the elevator car 10 in the hoistway is determined by counting the pulses 20A provided by a pulse generator 20. Pulse generator 20 may include a pulse wheel and a suitable pick-up, with the pulse wheel being rotated in response to car travel via a timing belt 22 which is driven in response to rotation of the traction sheave 18. The pulse generator 20 may provide a pulse for each predetermined standard increment of car travel, such as a pulse for each 0.25 inch of car travel.

The floor selector and speed pattern generator function 32 keeps track of car position by counting pulses 20A, and it keeps track of the calls 28. When a call 28 for elevator service is registered, the speed pattern generator 32 generates a digital speed pattern 32A which initiates a run of the elevator car 10 in the proper direction to serve the call. The digital speed pattern 32A is applied to a speed pattern selector and D/A converter function 42, which provides an analog speed pattern signal VSP for a drive controller 24. The drive controller 24, which may be conventional, compares the speed pattern VSP with a signal responsive to actual car speed, to develop an error signal. The actual car speed may be derived from pulses 20A, it may be derived from a separate DC tachometer, or the like. The error signal may be used, for example, to control the firing angle of a dual bridge solid-state converter, to provide a DC voltage of the proper magnitude and polarity to cause the elevator car 10 to follow the speed pattern.

The floor selector and speed pattern generator function 32 determines when the elevator car 10 reaches a predetermined slowdown distance from the target floor, i.e., the floor at which the elevator car is to stop. This point may be determined by comparing the car location in terms of the pulse count, with the location of the target floor, which is a count stored in a suitable memory, also in terms of the pulse count. When the predetermined slowdown distance is reached, the floor selector and speed pattern generator function 32 provides a true logic signal 32B, and it also initiates the slowdown phase of the speed pattern VSP. The distance pulses 20A may be used to generate a distance-to-go to the landing signal, which may be used to generate the pattern for the slowdown phase of the run.

Figure 2:
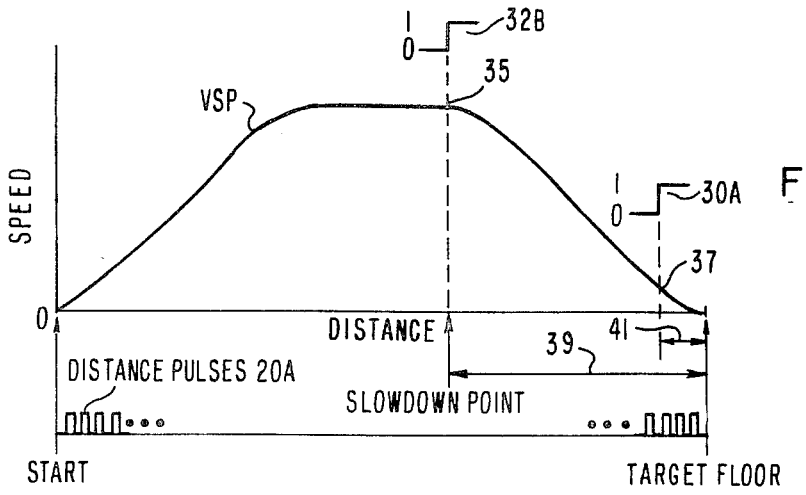
FIG. 2 is a graph which illustrates a speed pattern VSP which may be generated by the running speed pattern generator and landing speed pattern generator shown in FIG. 1.

FIG. 2 illustrates the speed pattern VSP, which starts at zero at the start of the run and increases smoothly to contract speed. When the elevator car reaches a predetermined slowdown point relative to the target floor, with this point being indicated at 35 on VSP, and with the slowdown distance being indicated at 39, the pattern VSP starts the slowdown phase of the run and the speed pattern generator 32 generates the true signal 32B. As hereinbefore stated, the slowdown phase of the run, starting at point 35, is generated in response to the distance-to-go to the landing. The landing is indicated by the arrow and the representation "target floor", in FIG. 2.

Elevator car 10 includes a target floor zone detector 30, which detects when the elevator car 10 reaches a predetermined fixed distance from the target floor, such as 10 inches. This predetermined fixed distance is indicated with the reference numeral 41 in FIG. 2. The fixed landing distance may be marked at each floor via suitable plate members fixed in the hoistway, such as plate members 1B, 8B and 9B at floors 1A, 8A and 9A, respectively. These plate members may be suitably shaped magnetic vanes, and the zone detector 30 may be electromagnetic windings or coils, as hereinbefore mentioned. When a plate member is detected relative to the target floor, zone detector 30 generates a true logic signal 30A, which is indicated in the graph of FIG. 2. Logic signal 30A is generated at point 37 on the speed pattern VSP.

When signal 30A is generated, it activates a car position detector 34. Detector 34 provides a signal 34A representative of the distance of the elevator car 10 from the target floor, while the elevator car is in the landing zone. Car position detector 34, which is responsive to the distance pulses 20A indicated in the graph of FIG. 2, may simply be a counter which is preset to a predetermined count at the start of the run of the elevator car 10. The predetermined count is the landing distance in terms of the standard increment, i.e., about 0010 1000 (analog 40) when the landing distance is 10 inches and the standard increment is 0.25 inch. Counter 34 is enabled to count down in response to a true signal 30A, and thus the output count 34A of counter 34 represents the distance-to-go from the elevator car 10 to the target floor, while signal 30A is true.

The distance-to-go signal 34A is applied to a landing speed pattern generator 36. Landing speed pattern generator 36 includes a plurality of speed patterns stored in a suitable memory, or memories, such as read-only memories (ROMS). When the run of elevator car 10 starts, the start signal may be used to select one of the landing speed patterns, such as thelanding speed pattern which will smoothly blend with the running speed pattern when the count which is generating the running speed pattern is accurate. The leveling speed pattern 36A outputs its initial value, and it remains at this initial level throughout the run, until the elevator car reaches the landing distance 41 indicated in FIG. 2. When the landing distance 41 is reached, signal 30A goes true and it activates a landing pattern selector 38. The landing pattern selector 38 compares the magnitude of the speed pattern signal 32A at this precise point in time with the magnitude of signal 36A, which is the initial value of the normal landing speed pattern. The landing speed pattern selector 38 selects the landing speed pattern which most closely matches the magnitude of the running speed pattern, and it provides a true signal on one of its memory select lines, according to the memory location selected. For purposes of example, it will be assumed that there are three different landing speed patterns stored in memory, referenced 36A-1, 36A-2 and 36A-N. Any number of patterns may be used, according to the maximum mis-match which can be tolerated. Landing pattern selector 38 drives one of its outputs true, to select the desired landing speed pattern.

Figure 3:
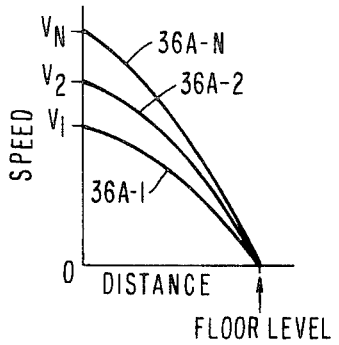
FIG. 3 is a graph which illustrates different landing speed pattern profiles which may be selected from the landing speed pattern generator.

The selected landing speed pattern is applied to the speed pattern selector 42. An AND gate 40 outputs a true logic signal SW when logic signals 30A and 32B are both true, which signal is applied to speed pattern selector 42. When signal SW goes true, the speed pattern is switched from pattern 32A to pattern 36A, and a suitable digital-to-analog converter (D/A) provides a corresponding analog signal. FIG. 3 is a graph which plots the three landing speed patterns 36A-1, 36A-2 and 36A-N in analog form, which patterns are stored in memory in the landing speed pattern generator 36, in digital form, and which are selectable by the landing pattern selector 38.

Figure 4:
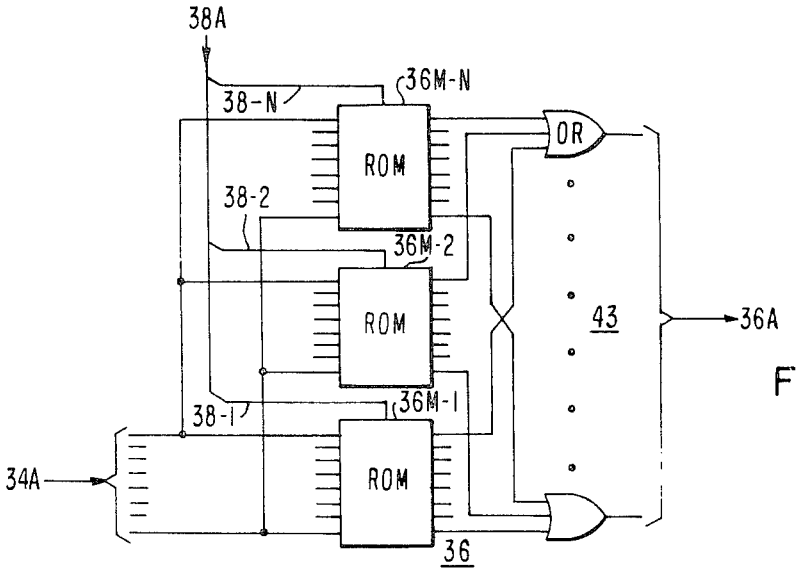
FIG. 4 is a schematic diagram of a landing speed pattern generator which may be used for this function shown in block form in FIG. 1.

FIG. 4 is a schematic diagram of a landing speed pattern generator 36 which may be used for this function shown in block form in FIG. 1. Landing speed pattern generator 36 includes three memory locations in read-only memory (ROM) referred to as memory locations 36M-1, 36M-2 and 36M-N, which locations store the landing speed patterns 36A-1, 36A-2 and 36A-N, respectively. The distance-to-go signal 36A is provided by counter 34 when signal 30A goes true, and signal 34A is applied to the input of each memory. One of the memory locations, such as memory location 36M-2 is preselected at the start of the run, and it will respond to signal 34A, outputting the initial value of pattern 36A-2. A plurality of OR gates 43 provide the output 36A of the selected memory location.

Figure 5:
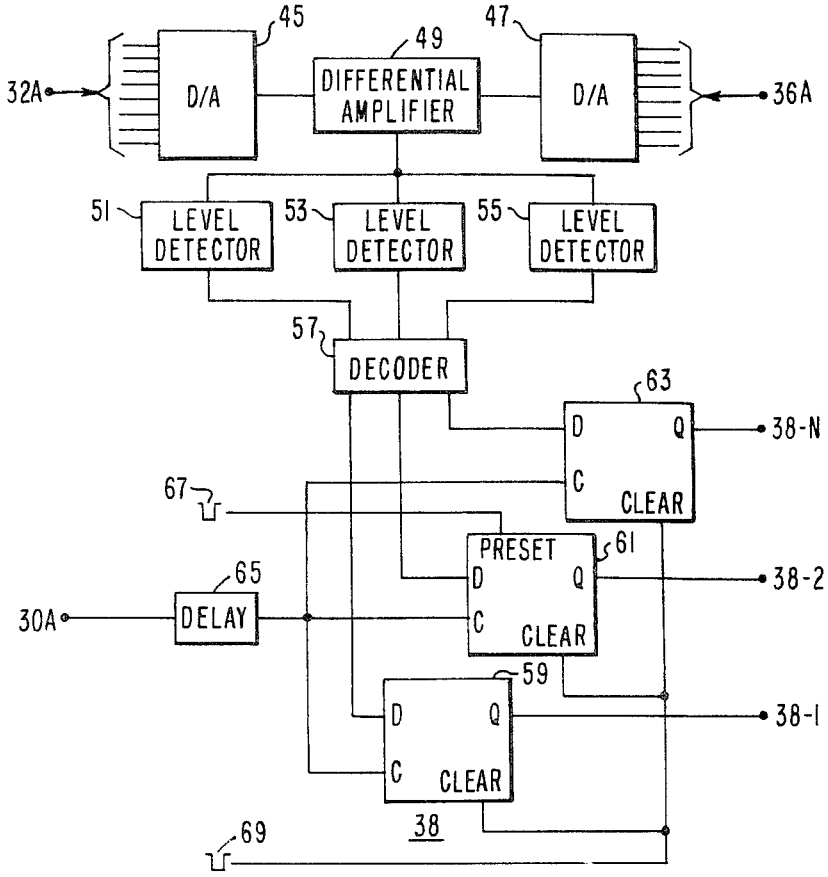
FIG. 5 is a schematic diagram of a landing speed pattern selector which may be used for this function shown in block form in FIG. 1.

FIG. 5 is a schematic diagram of a landing-pattern selector 38 which may be used for this function shown in block form in FIG. 1. While this function may be performed digitally, FIG. 5 illustrates an analog embodiment in which the digital pattern signals 32A and 36A are both converted to analog form in D/A converters 45 and 47, respectively. A differential amplifier 49 provides an output signal having a magnitude responsive to the difference between these two signals. The output of differential amplifier 49 is applied to a plurality of level detectors 51, 53 and 55, such as operational amplifiers connected as level detectors, with each operational amplifier having a different reference voltage applied to one of its inputs. The outputs of the level detectors are applied to a decoder 57, which drives one of its outputs true according to the pattern of true inputs. The true output of decoder 57 may be memorized for the remainder of the run by D-flip-flops 59, 61 and 63. Flip-flop 61, for example, may be pre-set by a signal 67 at the start of the run to cause it to provide a true signal 38-2, which selects landing speed pattern 36A-2. After decoder 57 provides a selection signal in response to the selection of the desired landing speed pattern, signal 30A, which is delayed slightly by delay 65 to allow the selection to be made, clocks all three flip-flops. The logic level of the D input is clocked to the Q output, which thus memorizes the output of decoder 57 at point 37 indicated in FIG. 2. The selected memory location is then addressed by the output of counter 34, which address is always responsive to the distance-to-go from the elevator car to the target floor. A reset signal 69 resets all flip-flops at the end of the run.

Figure 6:
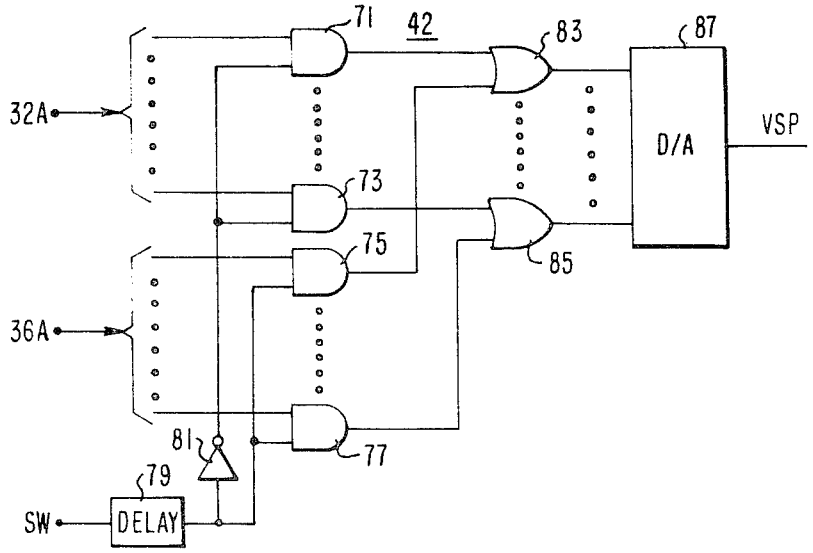
FIG. 6 is a schematic diagram of a speed pattern selector and D/A converter, which may be used for these functions shown in block form in FIG. 1.

FIG. 6 is a schematic diagram of a speed pattern selector and D/A converter which may be used for this function shown in block form in FIG. 1. Selector 42 includes a dual input AND gate for each bit of signal 32A, with two AND gates 71 and 73 for the LSB and MSB, respectively, being illustrated, and a dual input AND gate for each bit of signal 36A, with two AND gates 75 and 77 for the LSB and MSB, being illustrated. The output signal SW from AND gate 40 in FIG. 1 provides signals for the remaining inputs of the AND gates, with signal SW being applied to a delay function 79, to enable the landing speed pattern selector 38 to makes its selection, and to the inputs of the AND gates associated with signal 32A, via an inverter gate 81. The output of delay element 79 is applied directly to the remaining inputs of the AND gates associated with signal 36A.

The outputs of the AND gates associated with signal 32A are each applied to one input of a plurality of dual input OR gates, with two OR gates 83 and 85 for the LSB and MSB, respectively, being illustrated. The outputs of the AND gates associated with signal 36A are applied to the remaining inputs of the OR gates. The outputs of the OR gates may be applied to a D/A converter, if the drive controller 24 utilizes an analog signal. If controller 24 is arranged to handle a digital speed pattern, D/A 87 would not be required.

When the speed pattern is in the portion between its start and point 37, indicated in FIG. 2, signal SW will be low and inverter gate 81 will provide a logic one for the AND gates associated with the running speed pattern 32A. Thus, signal 32A will be applied to the OR gates and to the D/A converter 87. When car 10 reaches the landing zone of the target floor, signal 30A will go true at point 37, inverter 81 will block the AND gates associated with the running speed pattern 32A, and the high signal SW will enable the AND gates associated with the landing speed pattern 36A which has been selected by the landing pattern selector 38. Thus, signal 36A will be applied to the D/A converter 87.

Instead of comparing signal 32A with signal 36A in function 38, it would also be suitable to compare signal 32A with a known fixed reference value, and to then select the appropriate landing speed pattern which closely matches the value of signal 32A at the point in time when signal 30A goes true.

We claim as our invention:

1. An elevator system having an elevator car mounted in a building to serve the floors therein, comprising:

speed pattern means for providing a running speed pattern for the elevator car when it makes a run, with said running speed pattern including a slowdown portion which is activated when the elevator car is to stop at a predetermined target floor, landing speed pattern means having memory means for storing a plurality of selectable landing speed patterns having different initial magnitudes, detector means for providing a predetermined signal when the elevator car reaches a predetermined landing zone distance from a target floor, selector means responsive to the magnitude of the slowdown portion of the running speed pattern when the detector means provides the predetermined signal, for selecting a landing speed pattern of the landing speed generator means in response to the magnitude of the slow-down pattern, and means for switching from the running speed pattern to the selected landing speed pattern.

2. The elevator system of claim 1 including means responsive to movement of the elevator car for providing a distance pulse for each predetermined increment of car travel, with said speed pattern means providing the slowdown portion of the run in response to said distance pulses.

3. The elevator system of claim 1 including means responsive to movement of the elevator car for providing a distance pulse for each predetermined increment of car travel, means responsive to the predetermined signal from the detector means and said distance pulses for providing a distance-to-go signal responsive to the distance from the elevator car to the target floor in the landing zone, and wherein the landing speed pattern means is responsive to said distance-to-go signal.

4. The elevator system of claim 1 wherein the landing speed pattern generator means outputs the starting magnitude of one of its selectable speed patterns, and the selector means compares this output magnitude with the magnitude of the running speed pattern when the detector means provides the predetermined signal, with the selector means using the magnitude of the difference resulting from the comparison to select one of the selectable landing speed patterns.

5. A method of providing a speed pattern signal for an elevator system, comprising the steps of:

storing a plurality of different landing speed patterns in a memory, providing a running speed pattern having a slowdown portion, detecting the value of the slowdown portion at the time the elevator car reaches a predetermined distance from a target floor, selecting a landing speed pattern from the stored landing speed patterns in response to the magnitude of the slowdown pattern, and substituting the selected landing speed pattern for the slowdown pattern.

* * * * *